US005447136A

United States Patent [19]

Hartmann et al.

[11] Patent Number: 5,447,136

[45] Date of Patent: Sep. 5, 1995

[54] IGNITION SYSTEM FOR INTERNAL COMBUSTION ENGINES

[75] Inventors: Ingrid Hartmann, Villingen; Udo Mai, Untrgriesbach, both of Germany

[73] Assignee: Vogt Electornic AG, Erlautal, Germany

[21] Appl. No.: 137,171

[22] PCT Filed: Apr. 3, 1992

[86] PCT No.: PCT/EP92/00753

§ 371 Date: Oct. 26, 1993

§ 102(e) Date: Oct. 26, 1993

[87] PCT Pub. No.: WO92/19863

PCT Pub. Date: Nov. 12, 1992

[30] Foreign Application Priority Data

Apr. 30, 1991 [DE] Germany ..... 41 14 087.7

[51] Int. Cl.[6] ..... F02P 5/14

[52] U.S. Cl. ..... 123/425

[58] Field of Search ..... 123/425, 609; 364/431.04, 431.08; 324/399

[56] References Cited

U.S. PATENT DOCUMENTS

| | | | |
|---|---|---|---|
| 4,366,800 | 1/1983 | Seeger et al. | 123/609 |
| 4,915,086 | 4/1990 | Ciliberto et al. | 123/609 |
| 5,043,900 | 8/1991 | Allen et al. | 364/431.04 |
| 5,056,497 | 10/1991 | Akagi et al. | 123/609 |
| 5,180,984 | 1/1993 | Murata et al. | 324/399 |
| 5,241,937 | 9/1993 | Kanehiro et al. | 123/425 |
| 5,268,843 | 12/1993 | Imai | 364/431.08 |
| 5,301,649 | 4/1994 | Achleitner et al. | 123/609 |

FOREIGN PATENT DOCUMENTS

| | | | |
|---|---|---|---|
| 3928726A1 | 8/1989 | Germany | 123/425 |

*Primary Examiner*—Raymond A. Nelli

*Attorney, Agent, or Firm*—Kirkpatrick & Lockhart

[57] ABSTRACT

The invention provides sparkplug firing on-time control in a manner to prevent misfiring, by detecting one of the onset of combustion or a predetermined time after the onset of spark firing, and then discontinuing the spark-plug firing. This insures no misfiring and more efficient use of the ignition system by avoiding unnecessary sparkplug firing once combustion is initiated.

12 Claims, 2 Drawing Sheets

IGNITION SYSTEM FOR INTERNAL COMBUSTION ENGINES

DESCRIPTION

Figure 1:
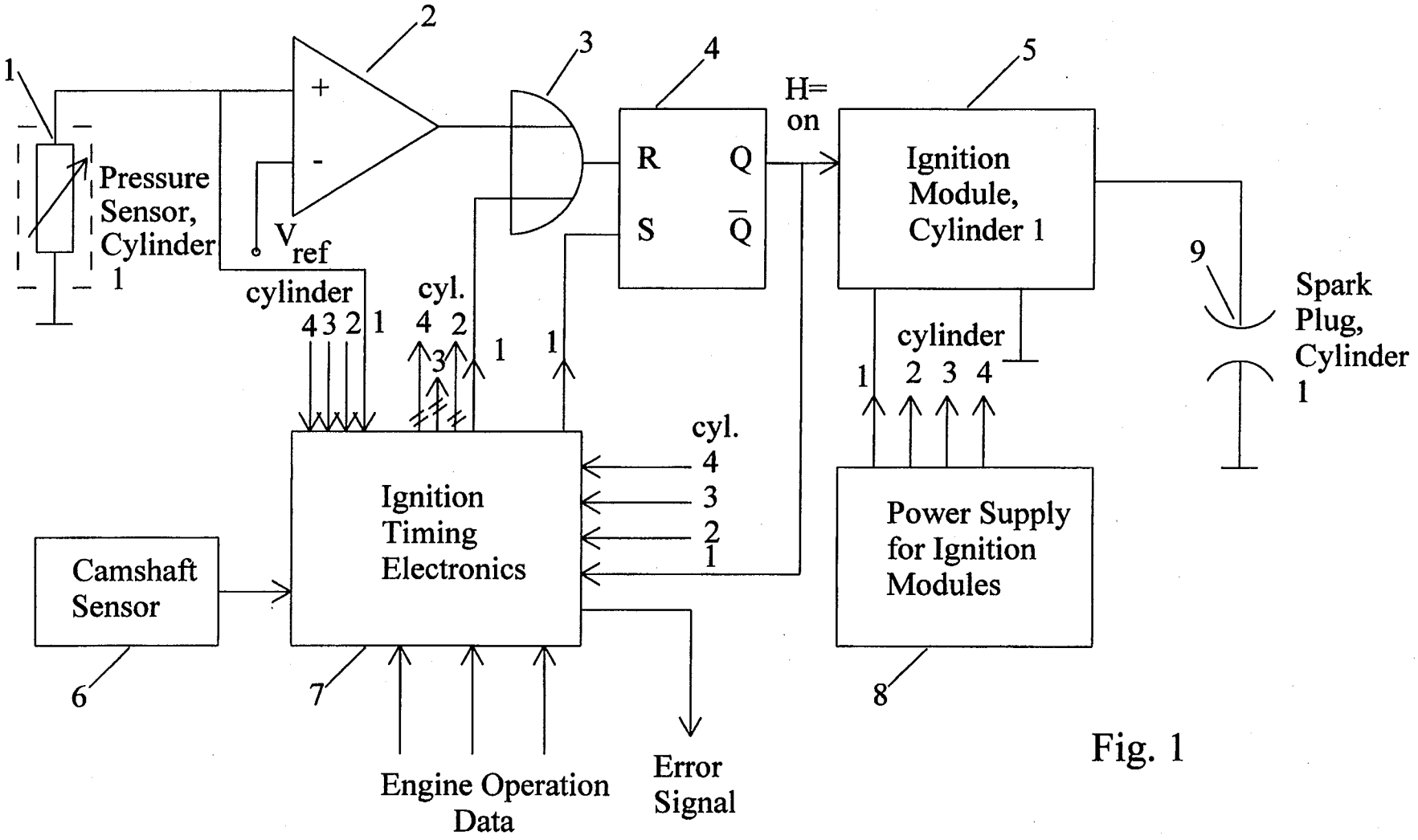

The invention concerns an ignition system according to the introductory part of claim 1.

In a modern ignition system for internal combustion engines, in particular for motor vehicles, there are a group of requirements some of which seem incompatible.

To obtain a good level of efficiency, the timing of the ignition of the fuel/air mixture in the cylinder must be very precise. For this high ignition energy must be provided. If one assumes normal operation, this high energy must be applied to the spark plug for only a short time. However, under unfavorable conditions, burning of the fuel/air mixture cannot be assured with short ignition current phases. For this reason, high voltage capacitor ignition, which is favorable for normal operation, has not been able to prevail.

Because of the exhaust regulations and because of the use of catalytic converters, misfires are extremely undesirable. In order to avoid misfiring, the prior art consists in significantly over-dimensioning the electrical ignition energy. This occurs in the known ignition systems according to the introductory part of claim 1, among other things, in that the ignition current is maintained for a relatively long time interval after the jump of the spark independently of the ignition process.

The prior art technology in this regard has the disadvantages that it does not in the final analysis prevent misfires with certainty.

delivers no information concerning misfires in order to prevent resultant damage (destruction of the catalytic converter) by timely service intervention.

causes high burning of the spark plug electrodes and thus reduces the firing precision as well as the service life of the spark plugs.

The object of the invention is to provide an ignition system according to the introductory part of claim 1 which offers high protection against misfires with extensively minimized burning of the spark plug electrodes.

The preceding object is accomplished through the characteristics of claim 1.

In the ignition system according to the invention, the ignition current for each ignition process is maintained after the jumping of the spark in each case only as long as is absolutely necessary for burning of the fuel/air mixture. Under normal conditions, this time is very short. However, under severe conditions it can also be relatively long. By means of the adjustment of the duration of the ignition current permitted by the ignition system according to the invention to the respective need, burning of the electrodes of the spark plugs is overall largely reduced. Furthermore, the ignition system according to the invention can very simply also be used to indicate increased danger of backfires and/or the occurrence of misfires, by additionally monitoring if and when burning occurs within the predetermined maximum time interval until the switching off of the ignition device for the individual cylinders.

The subclaims concern preferred embodiments of the ignition system according to claim 1.

The invention is explained below with reference to two exemplary embodiments using the drawings.

The figures depict:

FIG. 1 the block diagram of the first embodiment, and

Figure 2:
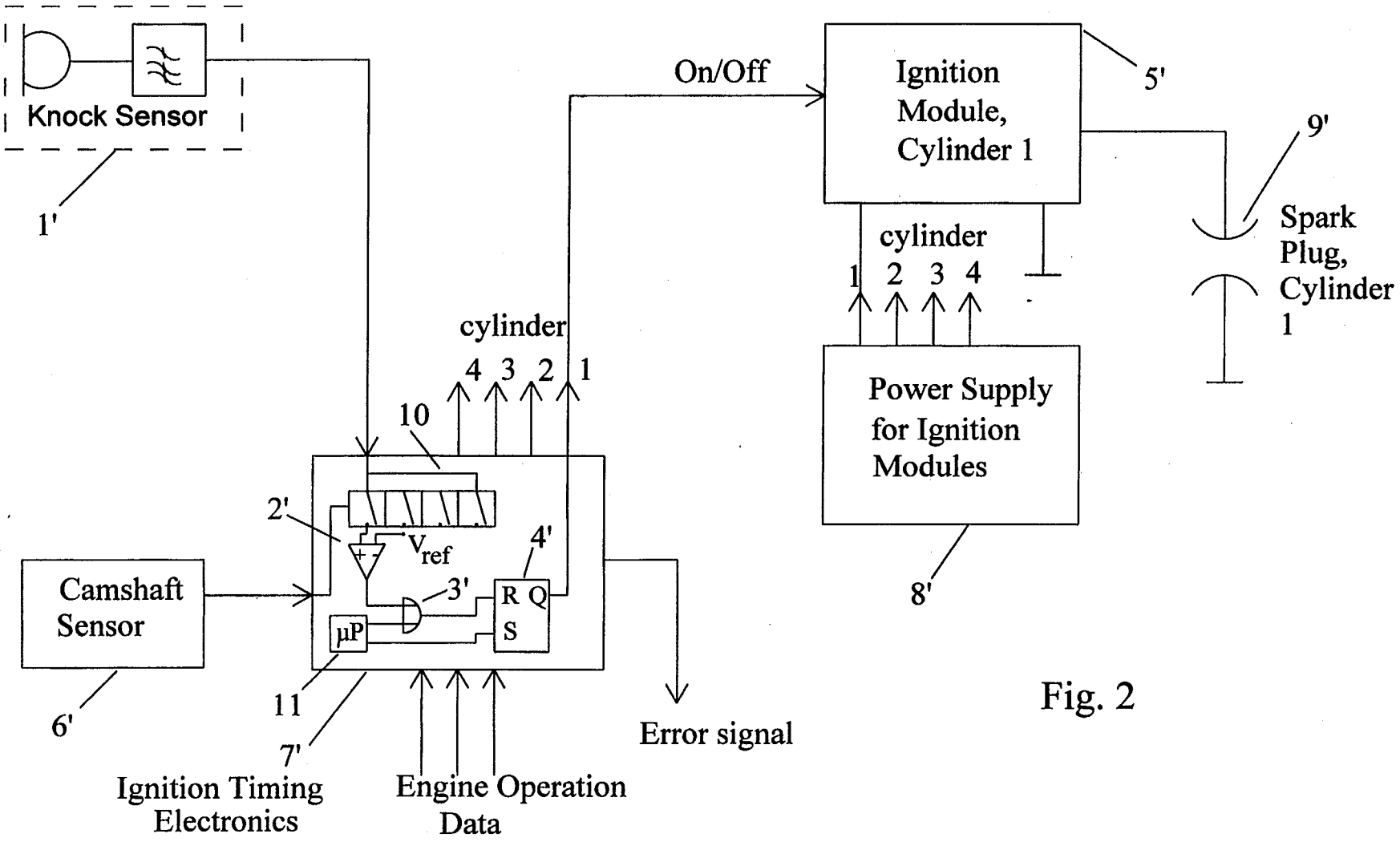

FIG. 2 the block diagram of the second embodiment.

In both exemplary embodiments depicted in the drawings, the ignition device individually allocated to each cylinder of the internal combustion engine for each cylinder has a separate ignition module, which can be switched on and off rapidly, i.e., virtually without delay and permits delivery in the switched-on state of an ignition current of indefinite length to the respective spark plug. Furthermore, the individual firings in the cylinders or the absence of burning during the maximum switched-on time of the ignition module is detected by sensor, and the respective ignition module is switched off immediately after successful burning of the fuel/air mixture in the associated cylinder. An ignition device suitable for this is described, for example, in patent application P 39 28 726.2 dated Aug. 30, 1989. The sensor required for this may also be used simultaneously as a knock sensor. It is also possible to use a shared acoustic sensor.

The basic idea of the ignition system according to the invention is to permit a spark to be applied in each case only until the fuel/air mixture in the cylinder is ignited. Usually the time for this process is very short and, accordingly, the electrical spark energy required is small. In those rare cases in which immediate burning does not occur, the current stream continues to flow through the spark plug, until the mixture is capable of ignition. Preferably, the amplitude of the current stream increases progressively to facilitate the ignition process. The same is also true for the high voltage when spark formation does not occur initially. Preferably the ignition processes are monitored not only for the occurrence or the non-occurrence of burning but also for the duration of the time interval between the theoretical ignition point and the actual time of burning, and if there are increasingly frequent relatively long ignition delays, this situation can be detected in the on-board computer and the driver can be signaled as a warning of an increased danger of misfires. This enables an early service intervention before misfires occur. On the other hand, the display of misfires informs the user that further operation of the engine is directly associated with a high risk to the engine or to parts thereof, e.g., the catalytic converter.

In the embodiment according to FIG. 1, the ignition module provided separately for each cylinder is labeled 5. For each cylinder, a separate sensor is provided, here in the form of a pressure sensor which responds to the pressure prevailing at any time in the cylinder.

The sensor 1 issues its signal of the mixture pressure to a comparator 2. This compares the signal with a reference voltage which is selected such that the only signals from the sensor 1 which arrive at the output of the comparator are signals which are triggered by a pressure in the cylinder which is greater than the compression. An OR gate 3 transmits these signals to a flip-flop 4, which was previously set in each case by means of ignition timing electronics 7, and resets this. The FF 4 switches on the ignition module 5 in the set state and switches it off in the reset state. Independently of the comparator 2, the FF 4 is reset via the OR gate 3 in the event of unsuccessful firing after approx. a half rotation of the crankshaft by a signal from the ignition timing electronics 7, and thus the ignition is switched off in any case. This process is detected and displayed (error signal). If the switching on of the ignition and the burning of the mixture occur very close together, the switching on of the ignition is delayed by the ignition timing electronics 7, to prevent knocking. A additional error signal, possibly issued via a separate line, is delivered by the ignition timing electronics 7 if there is actually burning but the time interval between the switching on of the ignition module for the theoretical ignition point and the burning exceeds a predetermined interval. To generate the error signal, the ignition timing electronics 7 receives data from the output of the FF 4 concerning the switch-on and switch-off time of the respective ignition module 5.

Instead of the pressure sensor 1, it is also possible to use an optical sensor for each of the cylinders.

With the exemplary embodiment according to FIG. 2, an ordinary acoustic sensor for knock detection is also used as sensor 1' for detection of explosive burning in the individual cylinders. The ignition timing electronics 7' here handles the switching on as well as the switching off of the respective ignition modules 5', of which one is provided separately for each cylinder just as in the embodiment according to FIG. 1. A multiple switch 10 controlled by the camshaft sensor 6' provides time windows for differentiation of the individual cylinders. A circuit arrangement, which essentially corresponds to the circuit arrangement with the components 2, 3, and 4 in the embodiment according to FIG. 1 and performs the same function as it, is connected downstream from each time window. The components are referenced here with 2', 3', and 4'. Just as in FIG. 1, the ignition electronics 7 receives information concerning the piston position from the camshaft sensor labeled 6' here, which delivers a signal corresponding to the current angular position of the camshaft. The power supply for the ignition module 5' is handled by a power pack 8', which corresponds to the power pack 8 provided for the same purpose in the embodiment according to FIG. 1.

The setting of the FF 4' and its resetting at the end of the predetermined maximum time interval is handled in the ignition timing electronics 7' of the ordinary microprocessor 11, also provided in the embodiment according to FIG. 1 (not depicted there), which microprocessor evaluates and connects the signals corresponding to the engine operation data, the signals of the camshaft sensor 6', and possibly additional signals fed to it which are important for operation of the engine, possibly under program control.

The embodiment according to FIG. 2 thus differs from the embodiment according to FIG. 1 essentially in that in it, instead of a separate sensor 1 for each cylinder, a shared sensor 1' for all cylinders is provided.

A variant to the above described mode of operation consists according to claim 11 in that for each of the cylinders the ignition device, i.e., in the case of the exemplary embodiments according to FIGS. 1 and 2 the relevant ignition module, for the theoretical ignition point as there in each case is switched on, after a time interval corresponding to the normal burning delay, i.e., the delay occurring in the normal case between the switching on of the ignition and the time of burning is again turned off independently of the sensor and is only then switched on again within the total maximum predetermined time interval provided for the ignition process with burning, possibly repeatedly, if the sensor responsible for the cylinder signals or has signaled no burning. This procedure permits a time lag of the sensors and/or of the increase in pressure in the cylinder associated with burning to be taken into account such that no unnecessary extension of the spark plug firing time is linked with it. Of course, through appropriate monitoring, the above-mentioned error and warning signals can also be generated and displayed in this case.

We claim:

1. An ignition system for an internal combustion engine having at least one cylinder wherein combustion of a fuel/air mixture supplied thereto is initiated by a spark generated by a corresponding spark plug when an ignition current is supplied thereto from a power supply, the ignition system comprising:

sensor means for sensing commencement of said combustion in each said cylinder and generating a corresponding combustion signal indicative thereof; and timing means connected to each said sensor means and said corresponding spark plug, said timing means further connected to said power supply for selectively permitting said ignition current to flow from said power supply to each said spark plug, said timing means discontinuing said flow of ignition current to each said spark plug upon the occurrence of the earlier of the expiration of a predetermined time period and receipt of said corresponding combustion signal.

2. The ignition system according to claim 1, wherein said sensor means comprises a sensor for each said cylinder of the engine.

3. The ignition system according to claim 1, wherein one said sensor is provided for a plurality of said cylinders of the engine.

4. The ignition system according to claim 1, wherein said sensor means is capable of detecting knocking in each said cylinder.

5. The ignition system according to claim claim 1 wherein said timing means permits a progressively increasing ignition current to flow to each said spark plug during said predetermined time period.

6. The ignition system of claim 1 wherein said timing means includes signal generating means for generating a corresponding display signal for each said spark plug each time said timing means discontinues the flow of said ignition current thereto upon said expiration of said predetermined time period and wherein said ignition system further comprises display means connected to said timing means for receiving each said display signal and generating a corresponding error message upon the receipt of a predetermined number of said display signals.

7. The ignition system according to claim 1, wherein each time said timing means discontinues said ignition current to each said corresponding spark plug that has not commenced combustion upon the expiration of said predetermined time period, said timing means again permits said ignition current to flow thereto until said sensor means has sensed combustion in said corresponding cylinder or until a second predetermined time period has expired.

8. The ignition system according to claim 2, wherein each said sensor comprises a pressure sensor.

9. The ignition system according to claim 2, wherein each said sensor comprises an optical sensor.

10. The ignition system according to claim 3, wherein said sensor is a vibration sensor.

11. The ignition system according to claim 10, wherein said vibration sensor is a microphone mounted on the engine.

12. The ignition system according to claim 10, wherein said vibration sensor is a piezoelectric element mounted on the engine.

* * * * *